US005414409A

United States Patent [19]

Voosen et al.

[11] Patent Number: 5,414,409

[45] Date of Patent: May 9, 1995

[54] ALARM SYSTEM FOR DETECTING AN AUDIO SIGNAL WHEN GLASS BREAKAGE OCCURS

[75] Inventors: Robert C. Voosen, Randolph; Christopher Hentschel, Kingston, both of Mass.

[73] Assignee: International Electronics, Inc., Canton, Mass.

[21] Appl. No.: 919,031

[22] Filed: Jul. 23, 1992

[51] Int. Cl.[6] ..... G08B 13/22

[52] U.S. Cl. ..... 340/541; 340/506; 340/514; 340/550; 340/691

[58] Field of Search ..... 340/550, 566, 541, 663, 340/521, 691, 514, 506, 636

[56] References Cited

U.S. PATENT DOCUMENTS

| | | | |
|---|---|---|---|
| 3,832,629 | 8/1974 | Cernek, Jr. | 340/636 |
| 4,283,657 | 8/1981 | Gordon et al. | 340/691 |
| 4,424,458 | 1/1984 | Buck et al. | 340/691 |
| 4,520,354 | 5/1985 | Umeda et al. | 340/691 |
| 4,810,998 | 3/1989 | Hwang | 340/541 |
| 5,192,931 | 3/1993 | Smith et al. | 340/550 |

*Primary Examiner*—Glen Swann
*Attorney, Agent, or Firm*—Robert F. O'Connell

[57] ABSTRACT

A processor, such as a microprocessor, responds to the detection of an input audio signal generated by glass breakage to cause an alarm to be indicated, such as at a remotely located alarm control panel. The system determines when the input power supply voltage supplied to the system falls below a selected low voltage level. The system is placed in a test mode of operation in response to a uniquely characterized, humanly generated input sound signal and then can be tested by any appropriate humanly generated input sound signal. The system continually monitors ambient background noise and determines when an absence thereof occurs so as to provide an indication of such absence to alert the user to the possibility that the system may have been purposely comprised. The system further uses a number of indicators arranged so that the meanings thereof are different depending on whether the system is in an alarm detection mode of operation or in a test mode of operation. Finally, the system operates in conjunction with a different intrusion event detection device so that, if a glass breakage signal is detected by the system, the detection of an intrusion event by the other device is monitored so as to confirm that a true intrusion has occurred before an alarm is indicated.

21 Claims, 6 Drawing Sheets

ALARM SYSTEM FOR DETECTING AN AUDIO SIGNAL WHEN GLASS BREAKAGE OCCURS

INTRODUCTION

This invention relates generally to glass breakage alarm systems and, more particularly, to such alarm systems which respond to audio frequency signals generated by glass breakage to produce an alarm indication.

BACKGROUND OF THE INVENTION

Glass breakage alarm systems generally are of two different types, namely, those which respond to mechanical vibrations imparted to the glass upon breakage and those which respond to audio frequency signals which are generated upon breakage. The latter systems are becoming more prevalent because only a single audio detector is required for a room having multiple windows, while the former systems require multiple detectors in a room, one at each window or window section which is likely to suffer glass breakage for entry therein.

Audio signal responsive systems normally utilize a suitable transducer pick-up device, e.g., a microphone, which responds to the audio signal generated by glass breakage and produces an audio frequency electrical signal containing many signal components over the audio portion of the frequency spectrum. Usually such signal is suitably filtered, normally using a single bandpass filter providing a filtered output signal within a selected range of audio frequencies or sometimes using a pair of bandpass filters, one operating over a relatively high frequency band and the other operating over a relatively low frequency band. The filtered output, or outputs, thereof, are suitably processed, e.g., using discrete logic electronic circuitry, to provide an alarm signal at a remote alarm control panel, for example, to produce an appropriate alarm indication thereat, e.g., an audible or visual indication, or both. Typically, for example, the detector system uses an alarm output relay which is normally activated, the relay being de-activated when an alarm condition occurs, thereby interrupting current flow through a circuit loop from the alarm control panel through one or more detectors interconnected with the control panel, as would be well known to the art. Interruptions of such current flow causes an audible and/or a visual alarm indicator to be activated.

Such systems normally obtain their operating supply voltage, e.g., a 12 volt, D-C supply voltage, from power supply circuitry in the alarm control panel, which includes a power voltage filter and voltage regulator to supply a regulated low voltage for operating the circuitry used in the system. If, unknown to the user, the low voltage input to the system is no longer available or drops below a usable low level, the alarm relay may drop out (i.e., become de-activated), thereby producing an alarm condition when no glass breakage has been detected. However, the user cannot tell whether there is a true alarm condition or whether there is a power related failure or whether some other problem has arisen. Such problem arises particularly when many detectors are supplied off the same wire and the number of detectors and the length of the wire tends to cause the input power voltage level at a particular detector to become marginal. In such circumstances it is difficult to troubleshoot the problem of having a detector trip an alarm condition for no apparent reason. It is desirable to be able to provide a user with information when such problem occurs because of a drop in power input voltage below a particular required level.

Moreover, such systems can fail by purposeful compromise thereof, as by blocking out the audio signals normally received by the system, e.g., the microphone sensor can be blocked out to render the sensor useless and, hence, the system fails to detect glass breakage as desired. Since such systems are of a passive nature, if audio input signal blockage occurs in currently available systems, such failure will normally go undetected.

Further, currently available systems require the use of suitably designed electronic equipment for generating specialized electrical signals in order to test the operation of the system and the components therein. Since system users do not normally have such equipment available to them, or do not have the skills for using such equipment, they must now arrange for costly on-site testing operations to be performed by skilled equipment operators. For that reason, users often fail to test the system frequently enough to determine its operability and may forego testing at all for long periods of time.

Further, in order to place the system in a test mode, rather than in an operating mode, for such testing operations, the equipment operator normally must have physical access to the circuitry within the alarm system housing in order to physically alter a component therein, e.g., in order to actuate a switch, to supply an appropriate jumper connection, or the like, for placing the system in a desired test mode.

Moreover, current systems utilize one or more light indicators, e.g., light-emitting diodes (LEDs), often merely for indicating when power to the system has been turned on or off and when the system has responded to an alarm condition, for example. Indication of other operating conditions are usually not provided, although it is often desirable to provide indications of other operating or operating failure conditions. At the same time it is desired that a minimum number of indicator lights be used for such purpose in order to keep the number of components and the cost of the system to reasonable levels.

Finally, currently available audio detection alarm systems normally operate independently of other alarm devices or systems. However, it would be desirable for an audio detection system to be adapted for monitoring another type of alarm device that may be used in conjunction therewith so that the operation of the other device can be suitably monitored so as to confirm the occurance of an intrusion event within a selected time period.

BRIEF SUMMARY OF THE INVENTION

In accordance with the improved audio signal detection and processing system of the invention, the aforesaid functions not previously available in such systems are now made available to provide a more reliable and effective glass breakage alarm system.

A suitable technique, preferably embodied in a simple voltage monitor circuit and in the operation of suitable processing means which responds thereto, for example, is provided to monitor the regulated low voltage power supply output in order to detect and indicate to a user when such power input voltage drops below a particular level, so that such operating condition can be duly noted by the user and can be corrected.

Further, the system of the invention is arranged to monitor general background noises, e.g., normal and naturally occurring sounds that are present in the environment in which the system operates, so that if there is an absence thereof, due to some purposeful compromise of the system operation, for example, such absence can be detected and suitably indicated so that a further investigation of the system operation can be made to determine if such a compromise has occurred.

Moreover, in accordance with the system of the invention, a specifically characterized, humanly generated sound signal can be used to place the system in a test mode of operation, without the need to physically access the circuitry in order to physically alter the system's operation, e.g., by having to activate a switch or to insert a jumper connection therein. The processing means is arranged to respond to such uniquely characterized humanly generated sound and, thereupon, to place the system in the desired test mode. For example, the processing means may be arranged to respond to a series of three hand-claps provided by a user in relatively rapid succession.

Further, in accordance with the invention, when in a test mode, the system is arranged to respond to easily generated audio signals which do not require special audio signal generating equipment, i.e., humanly generated sound signals, as readily generated by a user without the need for special electronic equipment, in order to provide a simple, quick and reliable test of the operation of the system, once it is placed in a test mode, without the cost of hiring specially trained service personnel and without using such specialized electronic equipment. Further, the system is arranged so that the test mode duration can be set to last for a specified time period following which the system automatically returns to the alarm detection mode of operation.

The system of the invention further provides a plurality of indicators, such as LEDs, the operations of which are arranged so that the same indicators can serve different purposes according to whether the system is in an alarm detection mode of operation or in a test mode of operation so that a relatively significant amount of information can be imparted to a user, while using only a relatively small number of indicator elements.

Finally, the system of the invention is arranged so as to monitor the operation of another type of alarm device, e.g., a separately operating motion detection alarm device which is used in conjunction with the audio detector glass breakage alarm system, so that confirmation of a detected intrusion event that is detected by both systems can be obtained within a selected time period and the possibility of false alarms can be reduced.

BRIEF DESCRIPTION OF THE DRAWINGS

The invention can be described in more detail with the help of the accompnaying drawings wherein.

DESCRIPTION OF THE PREFERRED EMBODIMENT

Figure 1:
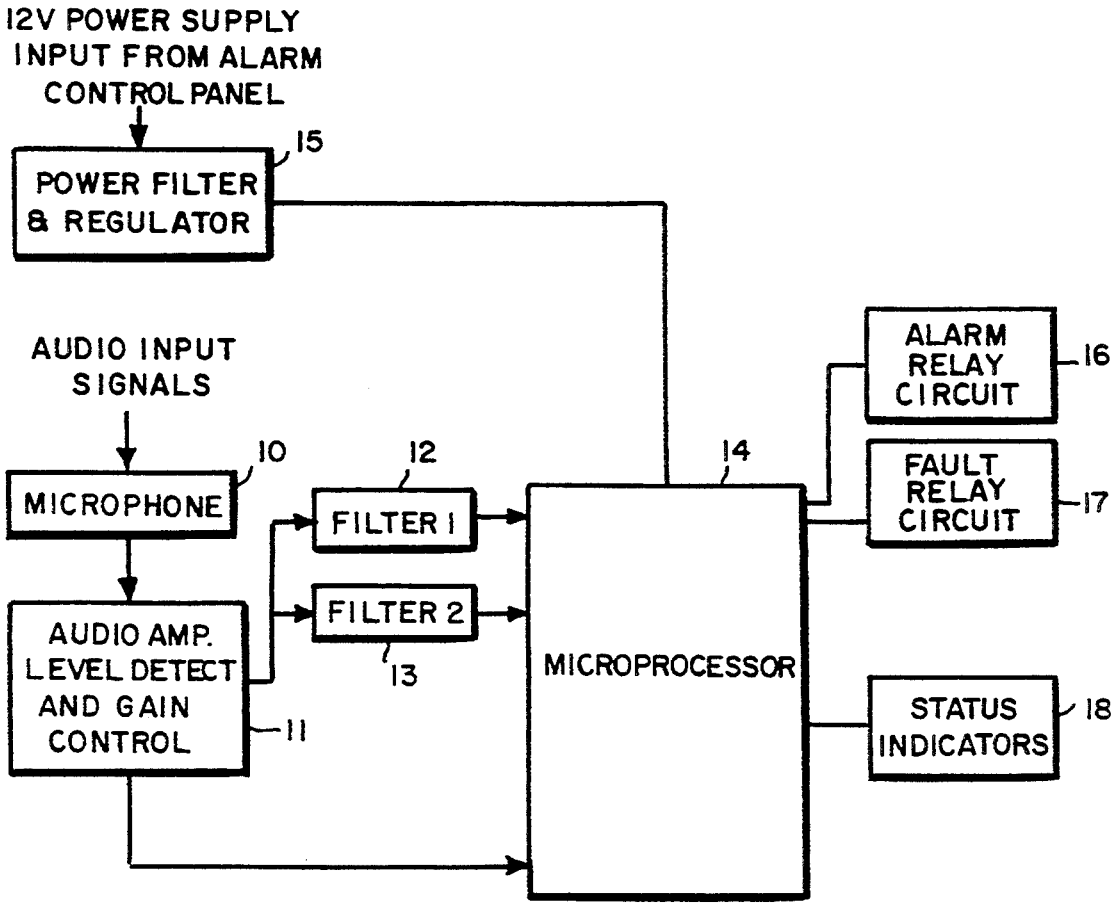
FIG. 1 PRIOR ART
FIG. 1 shows a block diagram of a typical audio alarm detection system of the prior art.

FIG. 1 depicts in block diagram form a typical audio detection system as used in the art. As seen therein, a microphone 10 appropriately placed within a room picks up audio input signals generated in the room which signals are suitably amplified by audio amplifier circuitry 11 which includes an audio amplifier having an adjustable amplitude level detector, for selecting a threshold input signal level below which the amplifier does not respond, and an adjustable gain control, such amplifier and associated circuitry being well known to those in the art. In a typical system the output of audio amplifier circuitry 11 is supplied to one or more filters, e.g., to a pair of bandpass filters 12 and 13, as shown, filter 12 responding to relatively high frequency audio signals, for example, and filter 13 responding to relatively low frequency audio signals, for example. The filtered output signals are supplied to processor circuitry 14 for suitable processing of signals supplied thereto. Processor circuitry 14 is supplied with a regulated power supply input voltage, e.g., a 12 volt D-C voltage from a remote alarm control panel (not shown) supplied to a power filter and voltage regulator 15 at the detection system which in turn supplies a regulated lower voltage, e.g., 5 volts, to the detector system, as would be well-known to the art.

Processor circuitry 14 responds to the filtered output signals, in any appropriate manner which would be well-known to the art, to indicate when an audio input signal which has been detected represents a glass breakage signal. When a glass breakage signal is so detected, an alarm indicator, e.g., audible, or visual, or both, at an alarm control panel is activated via a suitable alarm output relay 16, for example, as discussed above, is well-known to those in the art. Normally, an indicator light at the alarm detection system itself, e.g., a red LCD, is turned on to signify an alarm condition. If the power supply input voltage falls below its normal level, the detector of FIG. 1 will not detect such a condition.

Status indicators 18, such as appropriate panel lights, e.g., light-emitting diodes (LEDs), provide one or more indications concerning the system operation, also as well-known to the art. Such indicators may be arranged to indicate when an alarm condition occurs, as discussed above, and to indicate a power on or off condition, for example.

Figure 2:
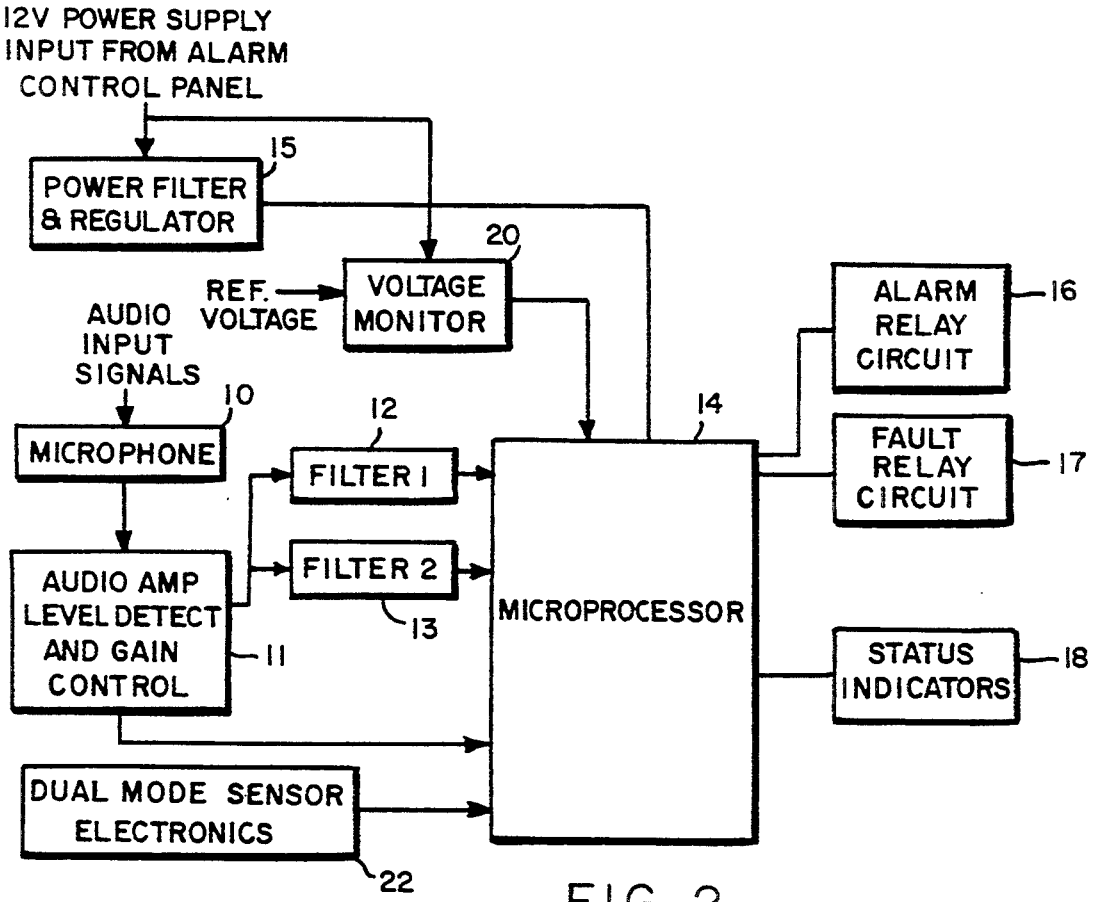
FIG. 2 shows a block diagram of an embodiment of an audio detection system in accordance with the invention.

FIG. 2 depicts a block diagram of an audio detection system in accordance with the invention which includes components of the type used in prior art systems and further includes a voltage monitor circuit 20 connected to the power supply input voltage and thence to a processor circuit which, for example, is a suitable microprocessor 14. Voltage monitor 20 continually monitors the power supply input voltage, e.g., 12 volts, supplied to the detector (e.g., to the filter/regulator circuit 15) and compares it to a specified reference voltage (e.g., using a suitable voltage comparison circuit), which reference voltage is selected to be below the normal 12 volt level, e.g., 10 volts. If the power supply voltage falls below the reference voltage level, a signal is supplied to the microprocessor 14 from monitor 20.

Figure 3:
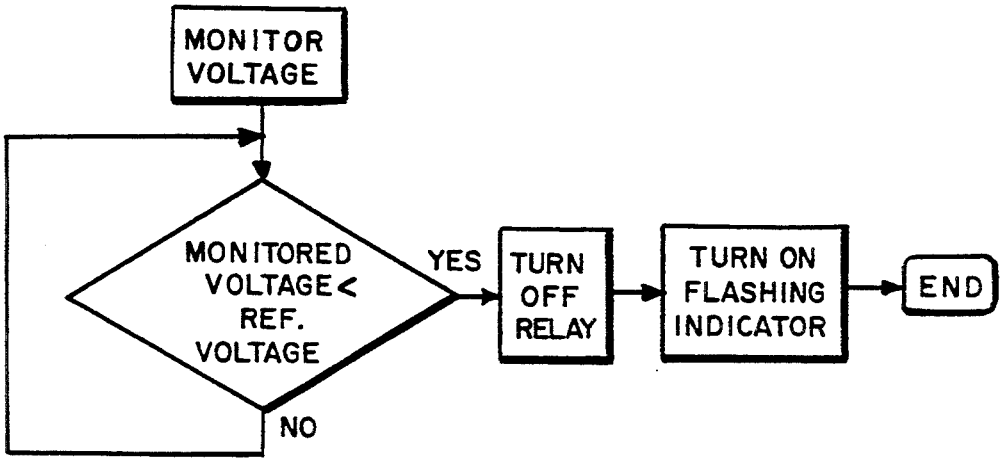
FIG. 3 shows a flow chart depicting a voltage monitoring operation of the system of the invention.

As seen in the flow chart of FIG. 3, the voltage monitor output signal is checked by the microprocessor and, if the monitored voltage is less than the reference voltage level, the alarm relay 16 drops out to indicate an alarm condition at the control panel. The microprocessor further supplies a pulsating signal to a status indicator light, e.g., to provide a flashing indicator light which then indicates to the user that a low voltage condition exists.

Thus, if the monitored voltage falls below the reference level, microprocessor 14 responds thereto and supplies a pulsed signal to an LED indicator, e.g., a red LED, so as to cause such LED to flash on-and-off at the pulse rate. A user knows immediately by merely noting the condition of the flashing red LED that the alarm condition signified at the control panel is a "false" alarm and that the alarm condition is due to the dropping of the input supply voltage below the reference level rather than to an alarm intrusion event.

Figure 4:
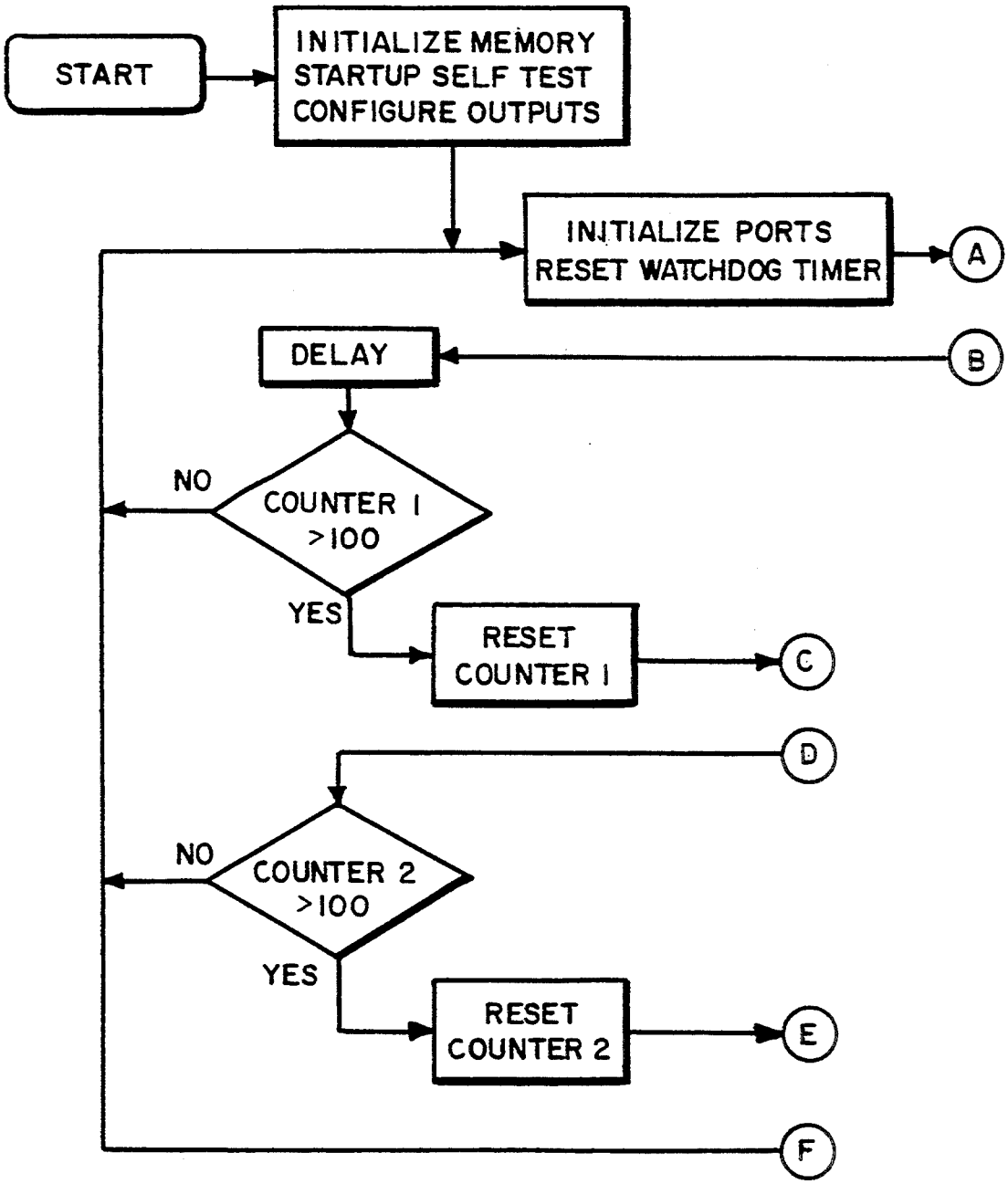
FIG. 4 shows a flow chart depicting an initialization operation for the system of the invention.

FIG. 4 depicts a flow chart of the initialization process required to place the audio detection alarm system of the invention into operation. Such initialization process requires the standard initialization of the microprocessor memory and various standard startup self-testing operations and output configurations normally required from microprocessor devices, as well as an initialization of the input and output ports to the microprocessor and the standard resetting of the conventional watchdog timer in such microprocessor circuitry, all of which are well-known to those in the art and do not form an inventive aspect, per se, of the system being described. Further, timing for assuring suitably synchronized processing operations are set, such timing being in the form of suitable timing counter circuitry as shown, as would also be well known to those in the art. The description of FIGS. 5–7 which follow discuss in more detail flow charts depicting the processing operations performed by the microprocessor in accordance with the invention.

Figure 5:
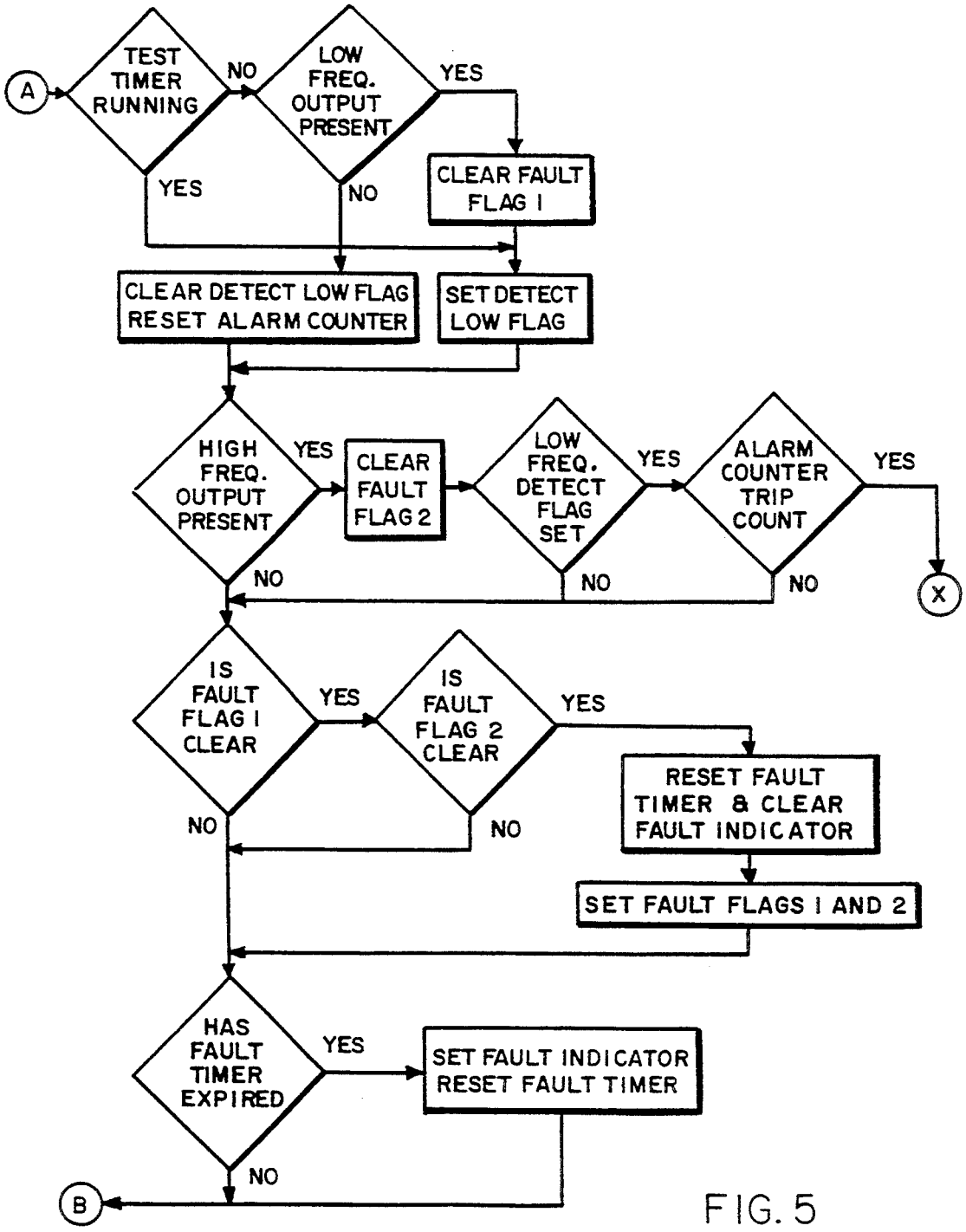
FIG. 5 shows a flow chart depicting alarm detection and background noise detection operations for the system of the invention.
Figure 7:
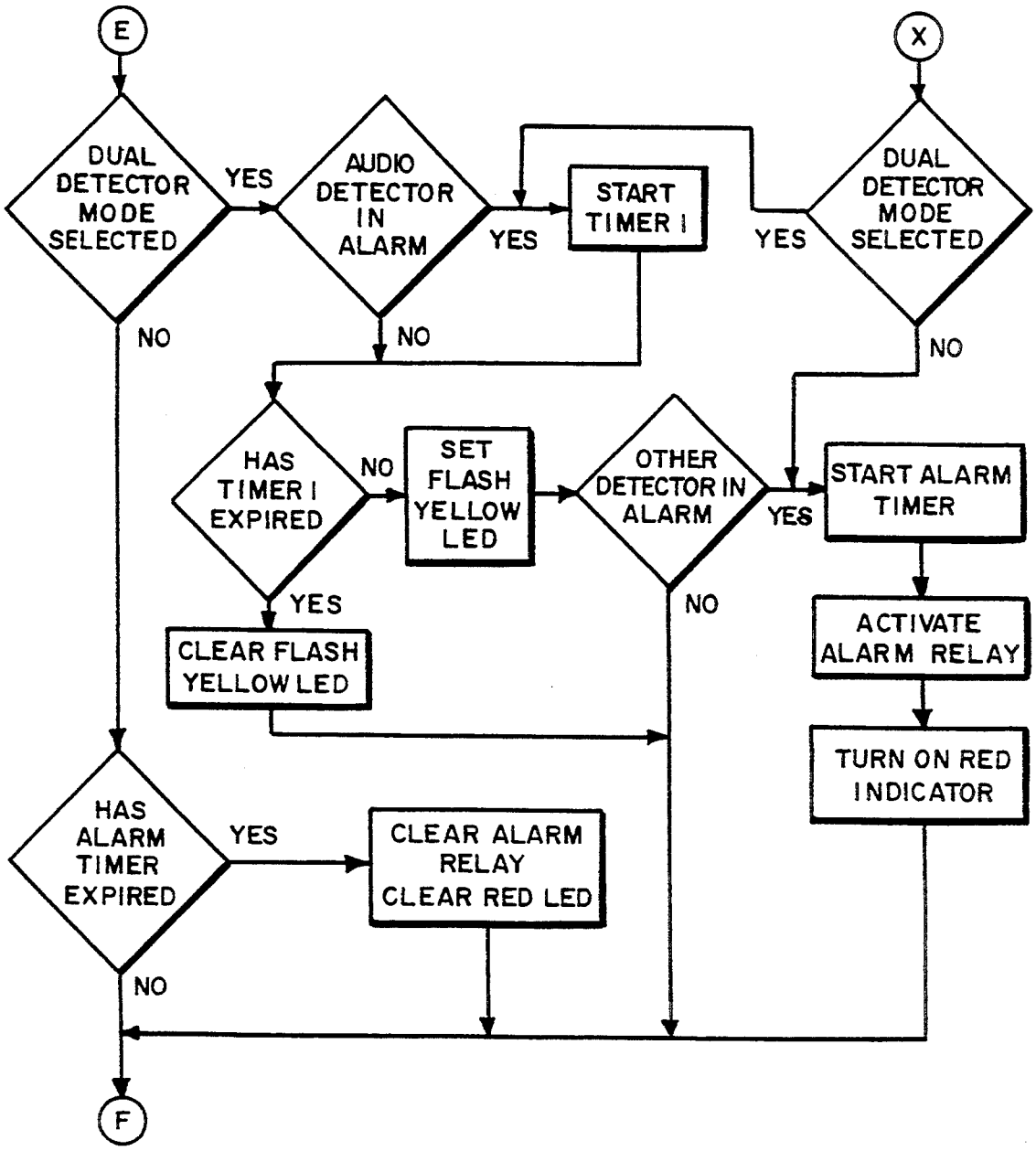
FIG. 7 shows a flow chart depicting a dual detection mode of operation of the system of the invention.

Thus, as seen in FIG. 5, when the system is in its alarm detection mode of operation and is not in a test mode of operation, i.e., the test timer (discussed below) is not running, the system checks the high frequency filter output and the low frequency filter output. If such outputs are present, fault flags are cleared and the signals are examined, for example, over a time period determined by an alarm counter and, if such outputs remain present for a sufficient time to trip the counter, the system determines that glass breakage has occurred. If the system is not in a dual confirmation mode of operation, the tripping of the alarm counter starts the alarm counter, activates the alarm relay (to produce an alarm indication at the remote alarm control panel), and turns on a red indicator light (LED) at the alarm detection unit, as shown in FIG. 7, to signify an alarm condition due to glass breakage. Once the alarm condition has been noted, the system can return to its port and watchdog timer initialization operations, as shown. Such alarm mode of operation is essentially the manner in which currently available audio detection alarm units, such as shown in FIG. 1, operate, as would be known to the art.

If, in an alarm detection mode, no high frequency and low frequency filter outputs are present, the system of the invention, however, further operates to monitor general background noise which is normally present over a selected time period to determine whether such background noise is absent over such time period, thereby indicating a possible problem in the system's operation or a possible purposeful compromise of the system operation, as discussed below.

As mentioned above, an audio detection alarm system normally is placed in an environment in which ambient background noise is usually present. However, if the background noise essentially disappears because, for example, the system has been purposely compromised so as not to respond to any input signal, such compromised condition cannot be detected in conventional audio detection alarm devices. For example, the microphone may be covered by placing a single piece of cellophane tape over the microphone hole in the cover of the system housing to render it ineffective to detect any glass breakage.

In accordance with the invention, such a compromised condition can be detected by recognizing the absence of ambient background noise that is normally present in the environment in which the system is placed. When the system is functioning properly, the background noise is detected by the microphone and supplied to filter circuits 12 and 13, one of which passes frequencies in a band from 5000 to 8000 Hz., for example, and the other of which passes frequencies in a band from 500 to 1000 Hz., for example.

Such processing operation is depicted in the lower portion of the flow chart of FIG. 5. If filter outputs are present but are not such as to represent a glass breakage condition, i.e., the alarm counter is not tripped, the status of the fault flags 1 and 2 associated with the high and low frequency filter outputs, respectively, are determined. If these are both clear, indicating that background noise is present, the fault indicator timer is reset and the fault flags are set and if the fault timer has not expired, the system returns to its normal timed alarm mode operation ready to detect either a glass breakage condition or the presence of background noise as required.

If, however, background noise is not present, there are no outputs present at the filters and either the high frequency fault flag or the low frequency fault flag, or both, are not cleared. If such condition continues until the fault indicator timer has expired, the fault indicator is set and an indicator light, e.g., a yellow indicator light (LED), is turned on to signify the absence of background noise over the time period selected for the fault timer. The user then can see that there has been an absence of background noise over such time period and can investigate to determine whether there is a faulty operation or whether there has been a purposeful compromise of the system.

The system is arranged also to respond to relatively simple humanly generated sound signals in order to test the operation thereof and to place the system in a test mode of operation so as to avoid the necessity of providing a specialized electronic signal generator to generate audio-input signals for test purposes. Thus, in accordance with the invention, the user can generate audio sounds in any convenient manner using only a user's own human resources, e.g., by clapping one's hands together, by whistling, by striking one's hand against an object such as a table or a wall, by stomping one's feet on the floor, and the like. Such simple and easy to generate actions, or combinations thereof, produce bursts of audible sound over a relatively wide range of audio frequencies. The microphone picks up such signal bursts and filters 12 and 13 respond thereto to supply filtered bursts thereof to the microprocessor 14 which can then process them to determine if the system is operating correctly.

Figure 6:
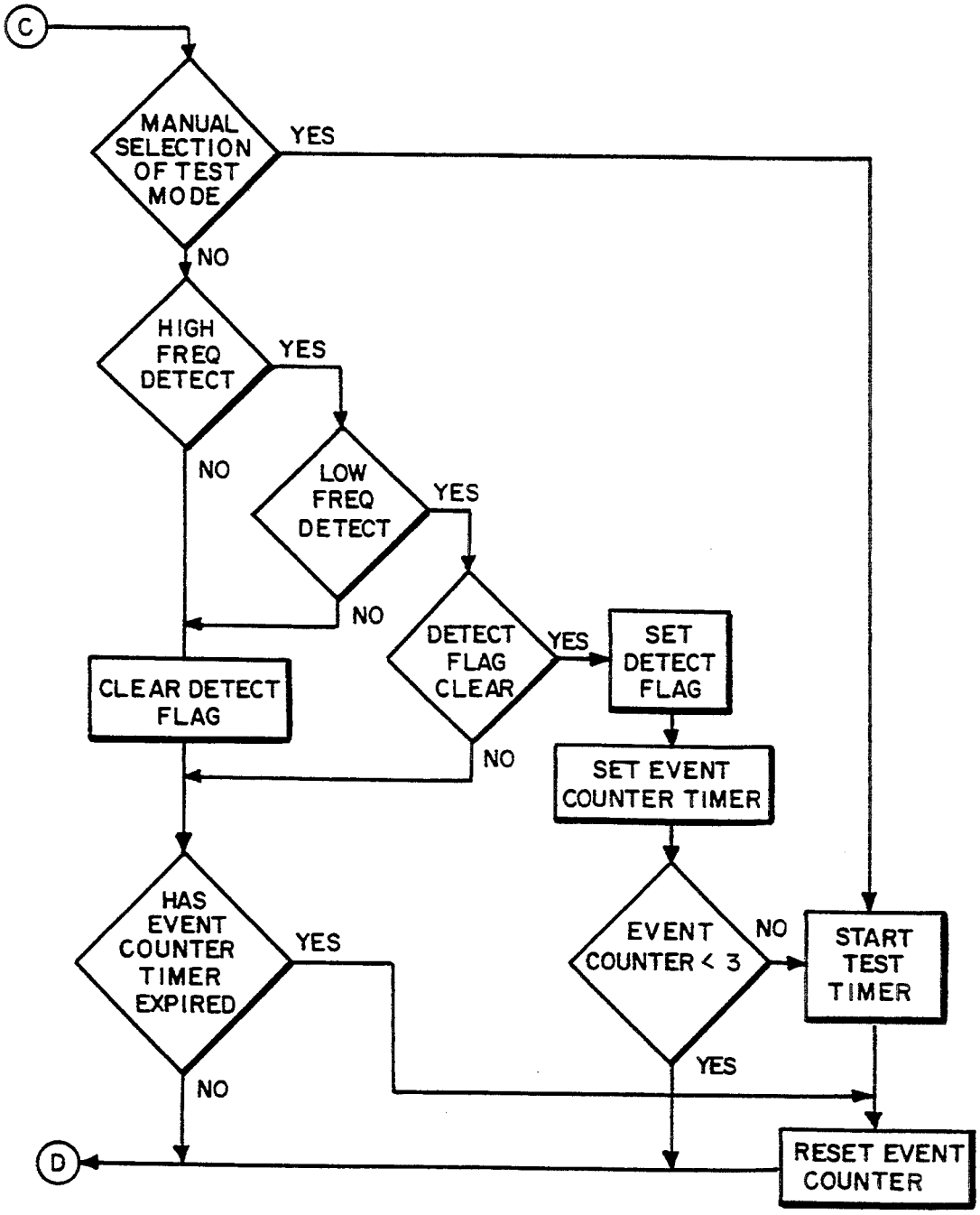
FIG. 6 shows a flow chart depicting a test mode of operation of the system of the invention.

FIG. 6 depicts a flow chart for test operations. As seen therein the system can be manually set in a test mode of operation, (as by a suitable jumper insertion, as in prior systems) or can be set therein by a uniquely characterized and easily generated sound which can be readily produced using human resources only. If manually set, a test timer is set for a selected time period during which suitable testing can be performed. Such operation may be used, for example, when initially installing the system so that relatively sophisticated instruments can be used by the installer to test the operation of the system. Once installed, the manual jumper can be removed to place the system in its alarm detection mode of operation. FIG. 6 then depicts also the process for placing the system in a test mode thereafter so that no manual test mode is required for such purpose.

In an exemplary embodiment of the process for such purpose, a uniquely characterized sound may be humanly generated, e.g., an appropriate hand clap sequence. To set a test mode, for example, a hand-clap sound can be uniquely characterized by a specified sequence thereof, such as three hand claps occurring within rapid succession, i.e., within a specified event time period, which sound sequence can be readily generated by a user.

As seen in FIG. 6, for example, the system responds to each hand-clap to produce high frequency and low frequency outputs from filters 12 and 13 which are monitored by the microprocessor. So long as no high or low frequency filter outputs are detected, the test detection flag is cleared (not set) and so long as the time period of an event counter timer (which represents the time period over which the unique three hand clap sequence must occur and be detected to invoke a test mode) has not expired, the system will remain in a condition to respond to such uniquely characterized sound sequence.

If such sequence has been generated by a user, for example, the high frequency and low frequency filters will provide detected outputs therefrom. In that case, if the detect flag is clear (not set) such flag will then be set to signify such filter detect conditions and the event counter time is set. For the first hand clap of the sequence that is detected, the event counter will be incremented by a single count and the system will be in condition to respond to the second hand clap of the sequence. When the second hand clap occurs, the detect flag will again be set and the event counter will again be incremented. When the third hand clap of the sequence occurs, the event counter is incremented and the count will then not be less than "3". The test timer will then be started to set up a test mode of operation.

If the event counter timer has expired by the time the third hand clap is detected, i.e., the three hand clap sequence is not fast enough to be completed within the specified time period of the event counter timer, the test mode will not be invoked, in which case the event counter is reset and a new sound sequence must be used to set up the desired test mode.

If, on the other hand, the event counter timer has not expired when the third hand clap has occurred, the test timer is started and the system is thereby placed in a test mode and becomes available for further testing. The user can use some appropriate, easily generated sounds, e.g., humanly generated, at one or more locations in the environment in which the system is being used to determine if the system responds thereto as discussed with reference to FIG. 6. Such tests can be performed so long as the test timer has not expired. When the timer expires, the system is then automatically placed back in its alarm detection mode of operation and is available to respond to a glass breakage condition or to background noise, as discussed above with reference to FIG. 5.

In the system of the invention, a plurality of status indicator lights can be used to display different conditions depending on whether they are assigned to respond to microprocessor signals generated in an alarm operating mode or in a test mode. For example, the system may utilize three indicator lights (e.g., LED's), one providing a red indication, another a yellow indication, and the third a green indication.

When the system is in its normal alarm mode operation, such lights may be assigned indicator functions as follows:

| Color | On | Off |
|---|---|---|
| Red | Alarm | No Alarm |
| Yellow | Background Noise not Present | Background Noise is Present |
| Green | Power On | Power Off |

In such mode the microprocessor supplies appropriate signals which will turn on or turn off the particular light involved to indicate the status of the conditions involved.

When the system has been placed in a test mode, as in the manner discussed above, for example, the microprocessor then generates turn on/turn off signals in response to different conditions so that the status of the lights provides an indication of the status of such different conditions. For example, in a test mode, it may be desirable to test the filters to determine if either or both of the filters are providing output signals in response to a test signal. Thus, in the test mode, the microprocessor responds to the filter output signals and places the lights in a flashing status in response thereto as follows:

| Color | Flashing On | Off |
|---|---|---|
| Red | (Not Affected) | |
| Yellow | Filter 12 Output is Present | Filter 12 Output not Present |
| Green | Filter 13 Output is Present | Filter 13 Output not Present |

Accordingly, the same lights are arranged to indicate different conditions depending on whether the system has been placed in its operating or in its test mode.

In some applications, it is further desirable to prevent false alarms in the system of the invention by using a confirming indication from another type of intrusion detection device which is used in conjunction with the audio detection alarm system of the invention. Such other detector, for example, may be a well-known motion detection device located on the premises where motion of an intruder is likely to be detected, or a stress detector located under the floor of the premises, or a vibration detector, for example. The intrusion event detected by the other device normally will occur relatively simultaneously or shortly after a glass breakage event and detection, i.e., at least within a reasonably selected time period after glass breakage occurs. Such time period may be within a few seconds or within several minutes, depending on the type of other device being used as the confirming detector.

In accordance with the invention, an output from the other detector is supplied to microprocessor 14 via suitable dual mode sensor interface electronics 22, as seen in FIG. 2. The microprocessor then processes the presence of such output, as depicted in the flow chart of FIG. 7.

As seen therein, when in a dual detector mode, if the audio detection system is in its alarm mode of operation and glass breakage is detected by the system, a timer (timer 1) is started. As long as the timer has not expired when in such condition, the microprocessor starts a timer and causes an indicator, e.g., a yellow indicator light (LED), to flash at a suitable flashing pulse rate. If the other detector has been placed in an alarm condition by an intrusion event, the microprocessor determines that such other device is in its alarm condition and starts an alarm timer. The alarm relay is activated to provide an alarm signal to the remote alarm control panel and to another indicator, e.g., a red indicator light (LED), which is normally turned on to signify that a confirmed alarm has occurred. The normal alarm mode of operation is then resumed. Thus, the glass breakage alarm detecting operation of the audio detector system is confirmed to indicate that a true alarm condition has occurred by the subsequent, or substantially simultaneous, presence of the alarm condition detected by the other detection device.

If the selected time period of the timer 1 expires before any alarm indication is received from the other device, no alarm signal is supplied to the remote alarm control panel and the local flashing indicator is turned off. The normal alarm detection operation condition is resumed by the audio detection system when the alarm timer expires.

If the system is not in a dual mode operation and the alarm timer has expired, the alarm relay and red indicator LED are cleared and normal alarm detection operation resumes. If the alarm timer has not expired, the system returns to normal operation immediately.

While the above embodiments of the system of the invention and the embodiments of the flow chart processes representing various aspects of the operation of the system of the invention are preferred embodiments, modifications thereof may occur to those in the art within the spirit and scope of the invention. Hence, the invention is not to be construed as limited to the particular embodiments discussed above, except as depicted by the appended claims.

What is claimed is:

1. An alarm detection system for detecting the presence of an audio signal when glass breakage occurs, said system comprising amplifier means responsive to an input audio signal for providing an amplified audio output signal;

filter means responsive to said audio output signal for providing one or more filtered audio signals;

processing means responsive to said one or more filtered audio signals for determining when said filtered audio signals represent an audio input signal that has been generated due to glass breakage;

means responsive to said determination for providing an alarm signal when said filtered audio signals represent an audio input signal that has been generated due to glass breakage;

means for supplying a power supply voltage for use in said alarm detection system;

means for monitoring the level of said power supply voltage; and means responsive to said monitoring means for determining when the level of said power supply voltage is below a selected level;

said processing means being responsive to said determining means for providing an indicator signal when said power supply voltage level is below the selected level; and visual indicator means which is turned off when said power supply voltage level is above the selected level and which is responsive to said indicator signal for turning on said indicator means when said power supply voltage is below the selected level to provide a visual indication of a false alarm condition.

2. An alarm detection system in accordance with claim 1, wherein said indicator signal is a pulsating signal and said visual indicator means is a light indicator which flashes on and off when said visual indicator means is turned on in response to said pulsating signal.

3. An alarm detection system for detecting the presence of an audio signal when glass breakage occurs, said system comprising amplifier responsive to an input audio signal for providing an amplified audio output signal;

filter means responsive to said audio output signal for providing one or more filtered audio signals;

processing means responsive to said one or more filtered audio signals for determining when said filtered audio signals represent an audio input signal that has been generated due to glass breakage;

means responsive to said determination for providing an alarm signal when said filtered audio signals represent an audio input signal that has been generated due to glass breakage;

said amplifier means being further responsive to a uniquely characterized humanly generated input audio signal; and said processing means being responsive to filtered audio signals which result from said uniquely characterized input audio signal for placing said alarm system in a test mode of operations.

4. An alarm detection system in accordance with claim 3 wherein said processing means responds to first and second filtered audio signals which result from said uniquely characterized humanly generated input audio signal to start first and second timers having specified time durations;

said processing means determining whether said first and second filtered audio signals are still present when said first and second timers expire at the end of said specified time durations; and said processing means incrementing a counter means when said first and second filtered audio signals are not present at the end of said specified time durations.

5. An alarm detection system in accordance with claim 4 wherein said processing means places said alarm system in a test mode of operation when the count of said counter means reaches a selected count number.

6. An alarm detection system in accordance with claim 4 wherein said uniquely characterized input audio signal comprises a selected number of humanly generated, relatively short bursts of audio sound in relatively rapid succession and said alarm system is placed in a test mode of operation when the count of said counter means reaches a count of equal to said selected number.

7. An alarm detection system in accordance with claim 6 wherein said selected number of relatively short bursts of audio sound are produced by humanly generated hand claps.

8. An alarm detection system in accordance with claim 3 wherein, when said alarm system is placed in a test mode of operation, said amplifier means responds to a humanly generated test input audio signal;

said processing means responds to at least one filtered audio output which results from said test input audio signal and turns on at least one indicator means to signify a successful testing of said system.

9. An alarm detection system in accordance with claim 8 wherein said test input audio signal is a humanly generated audio sound having either high frequency or low frequency components, or both.

10. An alarm detection system in accordance with claim 3 and further including test timing means for automatically placing said system back into its alarm detection mode of operation after a selected time duration of said test timing means.

11. An alarm detection system in accordance with claim 3 wherein said alarm system is normally in an alarm detection mode of operation when it is not placed in said test mode of operation, and further including a plurality of indicator means, the operating status of each of which has a first meaning when said alarm system is in said alarm detection mode of operation and a second meaning when said alarm system is placed in a test mode of operation.

12. An alarm detection system in accordance with claim 11 wherein said plurality of indicator means includes a selected number of visual indicators.

13. An alarm detection system in accordance with claim 12 wherein said visual indicators are light emitting devices.

14. An alarm detection system in accordance with claim 12 wherein said filter means includes a high frequency filter and a low frequency filter and said plurality of visual indicators indicate an alarm status, a power on status and a background noise presence status when in said alarm detection mode of operation and wherein at least two of said visual indicators indicate the presence of filtered audio signals at the outputs of said high frequency and low frequency filters when in said test mode of operation.

15. An alarm detection system for detecting the presence of an audio signal when glass breakage occurs, said system comprising amplifier means responsive to an input audio signal for providing an amplified audio output signal;

filter means responsive to said audio output signal for providing one or more filtered audio signals;

processing means responsive to said one or more filtered audio signals for determining when said filtered audio signals represent an audio input signal that has been generated due to glass breakage;

means responsive to said determination for providing an alarm signal when said filtered audio signals represent an audio input signal that has been generated due to glass breakage;

said amplifier means being further responsive to ambient input audio background noise signals having an amplitude above a selected level, said noise signals being generated in an environment in which said alarm system is placed; and said processing means responding to said ambient input audio background noise signals for turning on an indicator means when said ambient input audio noise signals are not present.

16. An alarm detection system in accordance with claim 15 wherein said processing means responds to said ambient input audio background noise signals and sets a timer means having a selected time duration when said an input audio noise signals are present; and said processing means re-sets said timer means for said selected time duration when said input audio background noise signals are present before the end of said selected time duration, said timer means continuing to be re-set before the end of each selected time duration if said input audio background noise signals are present.

17. An alarm detection system in accordance with claim 16 wherein said processing means responds to said ambient input audio background noise signals so as to turn on an indicator means if said input audio background noise signals have not been present during the time duration of said timer means to signify the absence of said ambient input audio background noise signals.

18. An alarm detection system in accordance with claim 17 wherein said processing means responds to the filtered audio signals from said filter means which result from said ambient background input audio background noise signals.

19. An alarm detection system in accordance with claim 18 wherein said filter means includes a high frequency filter and a low frequency filter and said processing means responds to the presence of output signals from both said high frequency and low frequency filters due to the presence of said input audio background noise signals to set and re-set said timer means.

20. An alarm detection system for detecting the presence of an audio signal when glass breakage occurs, said system comprising amplifier means responsive to an input audio signal for providing an amplified audio output signal;

filter means responsive to said audio output signal for providing one or more filtered audio signals;

a single processor responsive to said one or more filtered audio signals for providing a first alarm indication for a selected time period when said filtered audio signals represent an audio input signal that has been generated due to glass breakage;

means for monitoring the output of a second alarm system which detects the occurrence of a different intrusion event and provides a monitored signal when said different intrusion event accompanies the occurrence of a glass breakage event;

said single processor detecting the presence of said monitored signal and providing a second confirmatory alarm indication different from said first alarm indication only when said monitored signal has been detected during said selected time period.

21. An alarm detection system in accordance with claim 20 wherein said first alarm indication is a light signal of a first color and said second confirmatory alarm indication is a light signal of a second color.

* * * * *